US006409056B1

(12) United States Patent
Lee

(10) Patent No.: US 6,409,056 B1
(45) Date of Patent: Jun. 25, 2002

(54) REFRACTORY PRODUCT

(75) Inventor: Stephen John Lee, Cardross (GB)

(73) Assignee: Didier-Werke AG (DE)

( * ) Notice: Subject to any disclaimer, the term of this patent is extended or adjusted under 35 U.S.C. 154(b) by 0 days.

(21) Appl. No.: 09/528,772

(22) Filed: Mar. 17, 2000

(30) Foreign Application Priority Data

Mar. 17, 1999 (GB) ..... 9906116

(51) Int. Cl.[7] ..... B22D 35/00
(52) U.S. Cl. ..... 222/606; 222/597
(58) Field of Search ..... 222/597, 606; 266/236

(56) References Cited

U.S. PATENT DOCUMENTS 5,733,469 A * 3/1998 Damasse et al. ..... 222/606

6,216,924 B1 * 4/2001 Orr et al. ..... 222/594

* cited by examiner

*Primary Examiner*—Scott Kastler
(74) *Attorney, Agent, or Firm*—R W Becker & Associates; R W Becker

(57) ABSTRACT

A refractory shroud device having an internal bore for through passage of molten metal, said device comprising, a body defining at least a portion of said bore, and having sufficient length to allow an end thereof to become immersed under normal operational conditions, and operationally engageable with said end a replaceable segment defining outlet means in flow communication with said bore, the said component having an internal profile adapted to provide a predetermined control over the flow of molten metal from the device.

5 Claims, 4 Drawing Sheets

REFRACTORY PRODUCT

BACKGROUND OF THE INVENTION

This invention relates to refractory products for use in the teeming of molten metals and, more particularly, to submerged entry conduit devices for shrouding molten metal flowing under gravity from one vessel to another. The particular characteristic feature of this invention being that the outlet geometry of such devices may be changed to alter and to improve control of the flow of molten metal through the device without exposing the processed melt to additional risks of atmospheric contamination.

Devices to which the invention applies are commonly of a type referred to as submerged entry nozzles, (hereinafter referred to as SEN) and the invention will be further described by reference to such well-known devices. Briefly the function thereof is to shroud molten metal from the atmosphere as it passes from one stage of a casting process to another i.e. from vessel to vessel or from a vessel into the casting mould.

In normal operation they encase the metal stream and penetrate below the level of metal in the lower vessel or mould thus allowing the metal to flow without contact with the external environment.

When combined with a glassy molten mould cover applied to the upper surface of the metal in the mould they provide an excellent means for eliminating the risk of re-oxidation of any reactive constituents of the metal resulting from contact with air.

The flow of molten metal from the SEN must distribute metal evenly into the mould and minimise turbulent flow effects and surface waves that can adversely influence the quality of the cast product.

Much work is directed to selecting the optimum bore and outlet port configuration so as to match the flow characteristics to the mould geometry and casting rates.

As most casting machines must cast a wide range of steel qualities and product sizes at different casting rates, each of which has a specific optimum flow requirement, the selection of a bore and exit port configuration is inevitably a compromise, especially on plants where changes to the order programme can result in a revision to the preferred criteria only a short time before casting occurs and well after the SEN has been set and the other vessel preparations made.

Whilst this compromise provides a technically acceptable operation it does not provide the highest technical standards for every casting combination.

In an attempt to increase flexibility, two component submerged entry systems have been developed where the upper portion is set into the vessel as normal whilst the lower immersed part can be offered against the nozzle of the upper portion at a later stage once the required casting conditions have been established. Various joint configurations are available between the two components but all have the risk of air aspiration through this joint once casting has commenced which increases the risk of re-oxidation, which is detrimental to the steel quality.

An aim of the present invention is to maintain the flexibility for adjustment of the flow characteristics achieved from an exchange nozzle assembly as late as possible in the operational sequence after the precise casting parameters have been established without increasing the risk of air ingress achieved by a conventional one piece SEN assembly. This aim is achievable by the invention described hereafter.

SUMMARY OF THE INVENTION

Thus according to one aspect of the present invention there is provided a refractory shroud device having an internal bore for through passage of molten metal, said device comprising, a body defining at least a portion of said bore, and having sufficient length to allow an end thereof to become immersed under normal operational conditions, and operationally engageable with said end a replaceable segment defining outlet means in flow communication with said bore, the said segment having an internal profile adapted to provide a predetermined control over the flow of molten metal from the device.

The submerge pour refractory assembly may be provided as a kit including a plurality of interchangeable submerged end nozzle segments having differing bore sizes, and differences in outlet port configuration such as exit angle, and variations in composition such as use of composite material combinations.

An advantage of this arrangement lies in the fact it provides process flexibility by the ability to exchange outlet segments in response to the exact process parameter requirements, yet the integrity of the casting process is not compromised with regard to contamination by air ingress because the joint between the shroud and outlet component lies below the slag level and is itself immersed in melt.

The manner in which the refractory product is assembled for operational use can be accomplished in a number of ways.

The parts may be formed to have connecting parts having close fitting surfaces such as by provision of a boss on one part and a recess in the adjoining part to provide corresponding surfaces of good fit.

The refractory product is envisaged as most usefully employed as in a sub-entry nozzle.

The design of the SEN remains as standard to below the immersion level. The geometrical adjustments are achieved by changing segments which fit within the lower immersed region and offer various options of bore sizes, exit angles and material combinations which can be introduced into the specially adapted shape of the lower SEN body. By this means the preferred exit flow can be established and as the joints between the two components are immersed below the metal surface in the mould there is no risk of air ingress to cause re-oxidation.

Conveniently, the changeable segment of the nozzle is retained in the body of the nozzle by a push fit mechanism.

Advantageously, the changeable segment of the nozzle is provided with a boss engageable in a corresponding recess in the body of the nozzle.

Alternatively, the changeable segment of the nozzle is retained on the body of the nozzle by a ceramic retainer passing through corresponding apertures in the body and tip of the nozzle.

Advantageously, the changeable segment of the nozzle may be provided with a sump for altering the flow of molten metal from the nozzle.

In another embodiment the desired flow characteristics can be provided by the inclusion of multiple segments within the bore of the nozzle.

BRIEF DESCRIPTION OF THE DRAWINGS

Embodiments of the present invention will now be described with reference to the enclose drawings in which.

DESCRIPTION OF PREFERRED EMBODIMENTS

Figure 1:
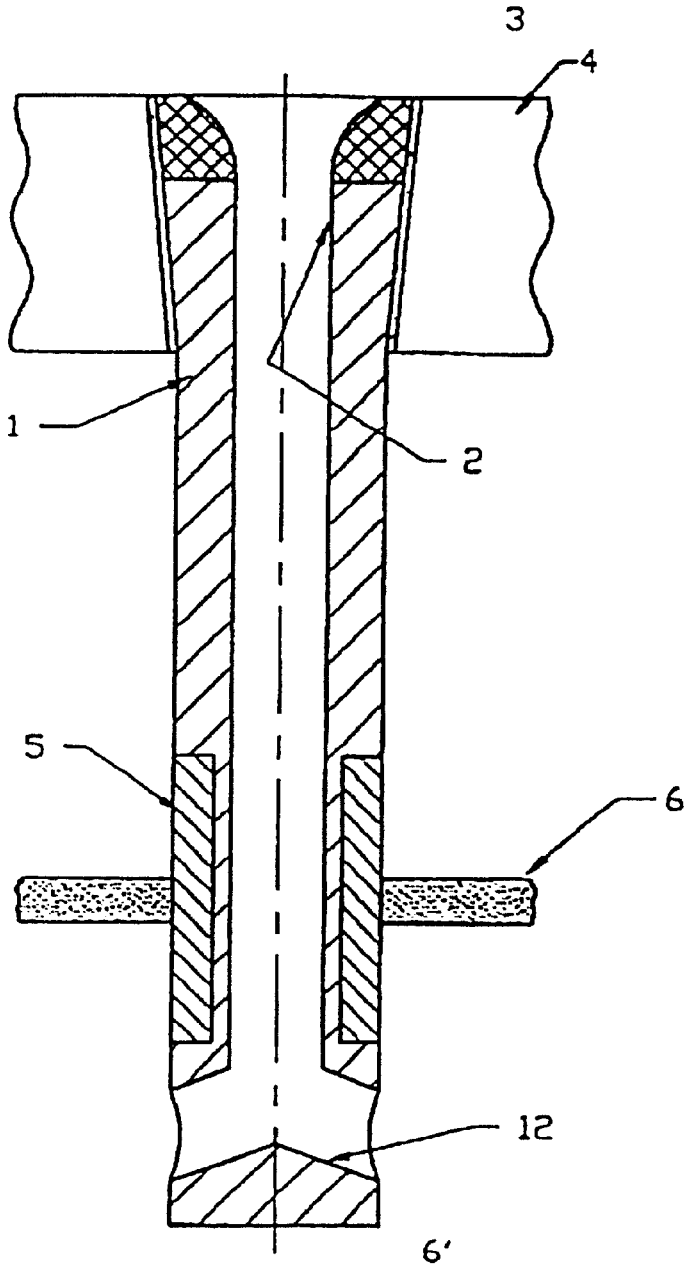
Fig. 1 Prior Art
FIG. 1 is a cross-sectional view of a standard SEN.

In FIG. 1, the SEN comprises a ceramic body 1 having an internal bore 2 that is selectively in communication with the interior 3 of an upper vessel 4 for the flow of molten metal from the upper vessel to a lower vessel or mould, 6', during a metal teeming or casting process. A band 5 of wear resistant material is provided around the outer surface of the body of the nozzle. The band is provided in the region of the body of the nozzle that is in contact with slag 6 lying on the surface of molten metal 6' in the lower vessel or mould. The lower exit ports 12 define the manner in which the molten metal flows from the main bore 2 into the lower vessel or mould 6'.

Figure 2:
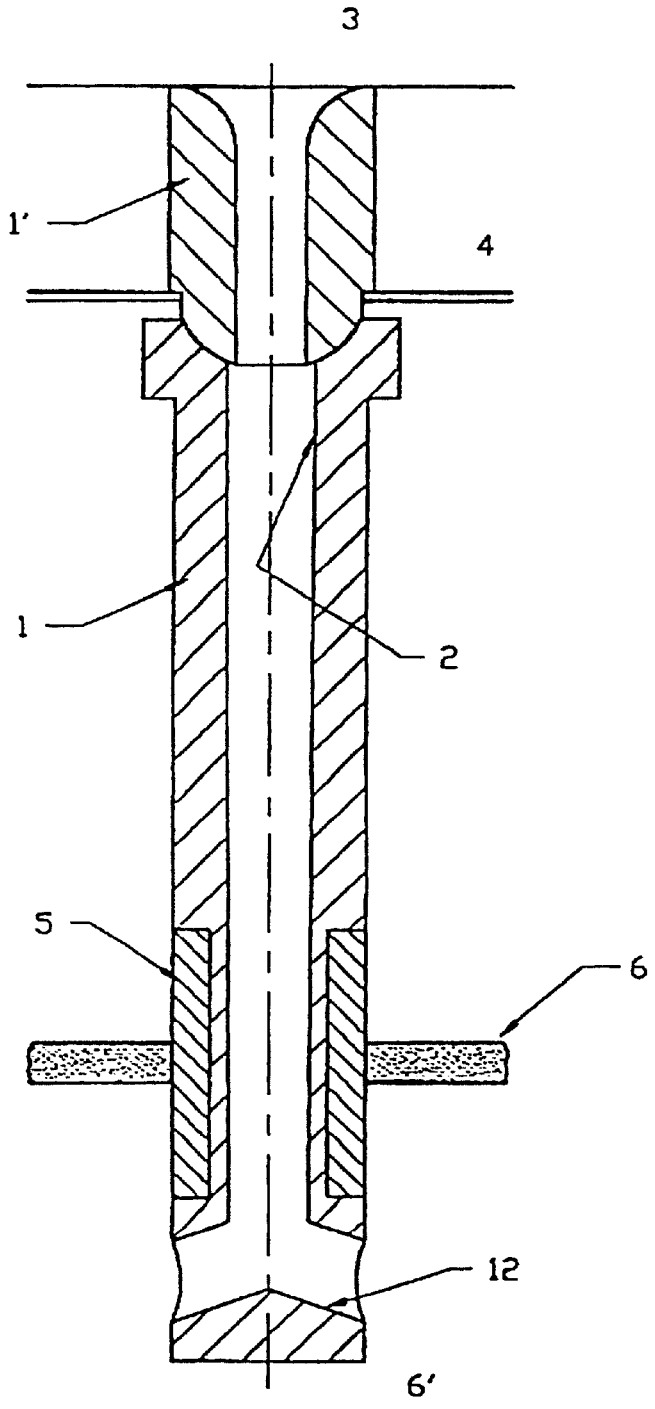
Fig. 2 Prior Art
FIG. 2 is cross-sectional view of a further known submerge pour assembly.

In FIG. 2, the submerge assembly comprises two parts. An upper nozzle 1' is located within the upper vessel 4. A submerge pouring shroud 1 is engaged against the spigot of the upper nozzle 1'.

The submerge pouring shroud 1 shows the same features as the SEN in FIG. 1, having a throughbore 2, wear resistant slag start band 5 and ports 12 through which the molten metal flows into the lower vessel 6' the use of the upper nozzle, submerge entry shroud arrangement allows the choice of different SES bore and port configuration to suit the process parameter requirements. The joint between the two components is however at risk of air aspiration which leads to a reduction in cast product quality.

Figure 3:
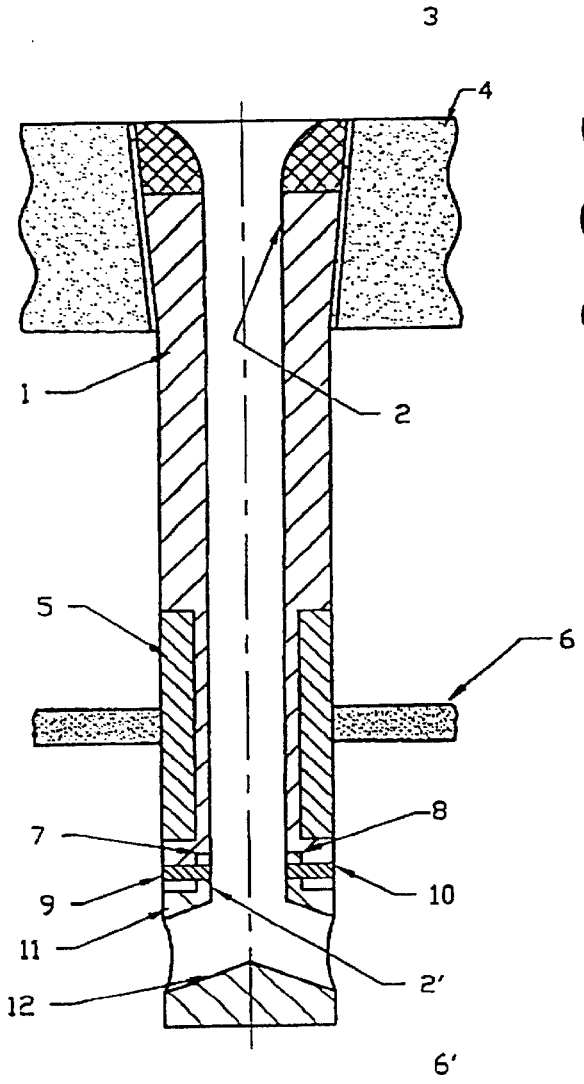
FIG. 3 is cross-sectional view of a refractory device according to one aspect of the present invention.
Figure 4:
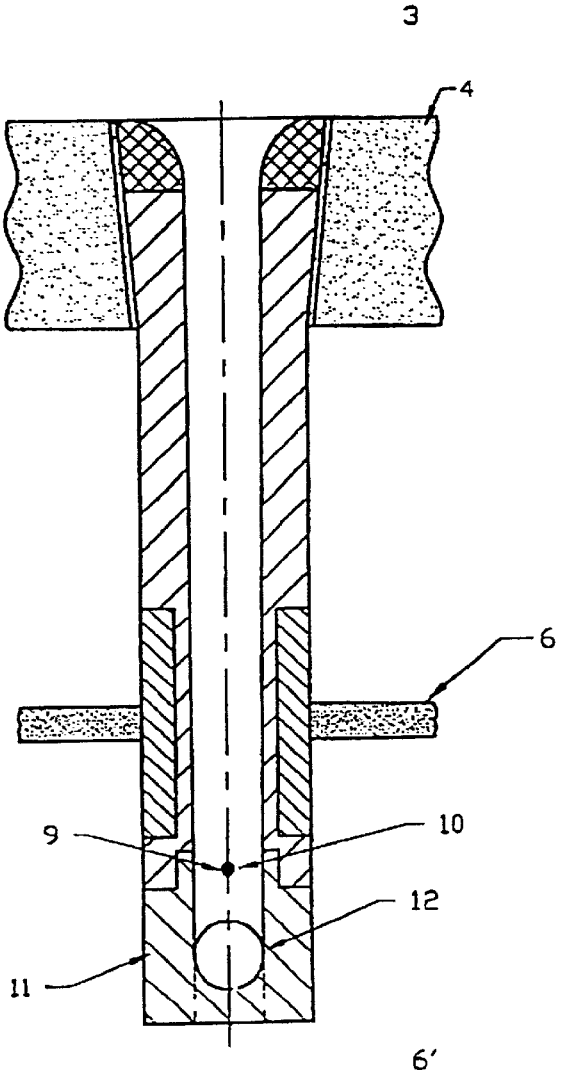
FIG. 4 is a cross-sectional view at 90° to FIG. 3.

FIG. 3 illustrates a first embodiment of a refractory device according to one aspect of the present invention.

The upper SEN throat, main body 1 and slag band 5 are as per the prior art designs described above. The lower segment 11 of the SEN providing the lower bore 2' and the exit ports 12 and is retained in the main body by a push fit connection comprising an internal boss 7 on the upper end of the lower segment 11 which is received in a correspondingly sized recess 8 in the upper SEN body:l. Alternatively, the boss may be provided on the body and the recess provided in the tip. A ceramic retainer 9 is then passed through corresponding apertures 10 in the end of the body 1 and the boss 7 of the lower segment 11.

The lower segment of the nozzle shown in FIG. 3 has two outlet ports 12 for deflection of the molten metal stream passing down through the lower bore 2'. The geometry of the outlet ports 12 can be varied to alter the flow characteristics of the molten metal into the lower vessel or mould, 6'.

Figure 5:
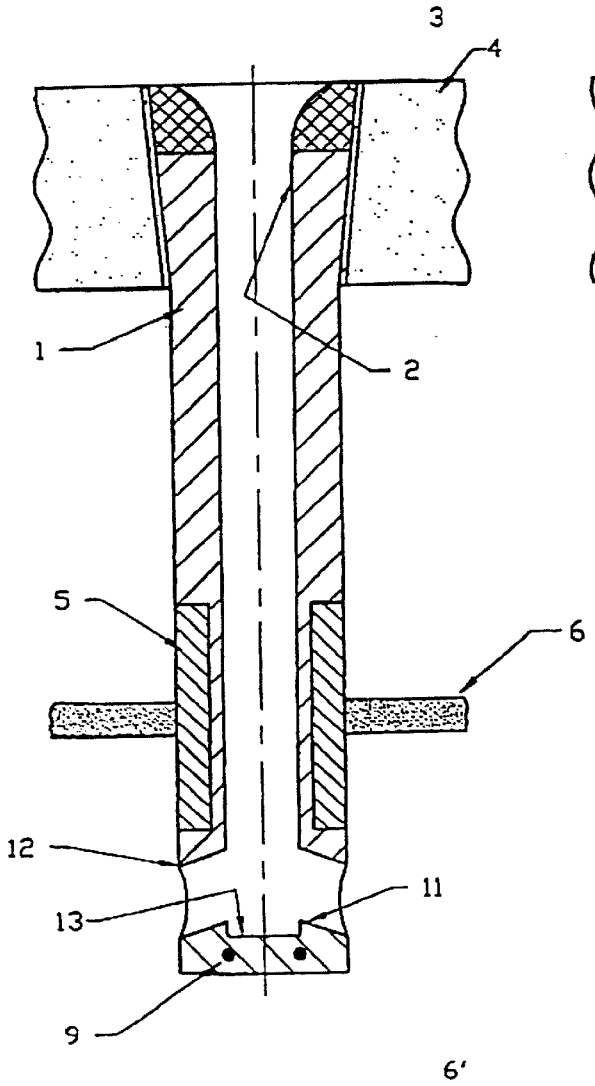
FIG. 5 is a cross-sectional view of a refractory device according to a further aspect of the present invention.
Figure 6:
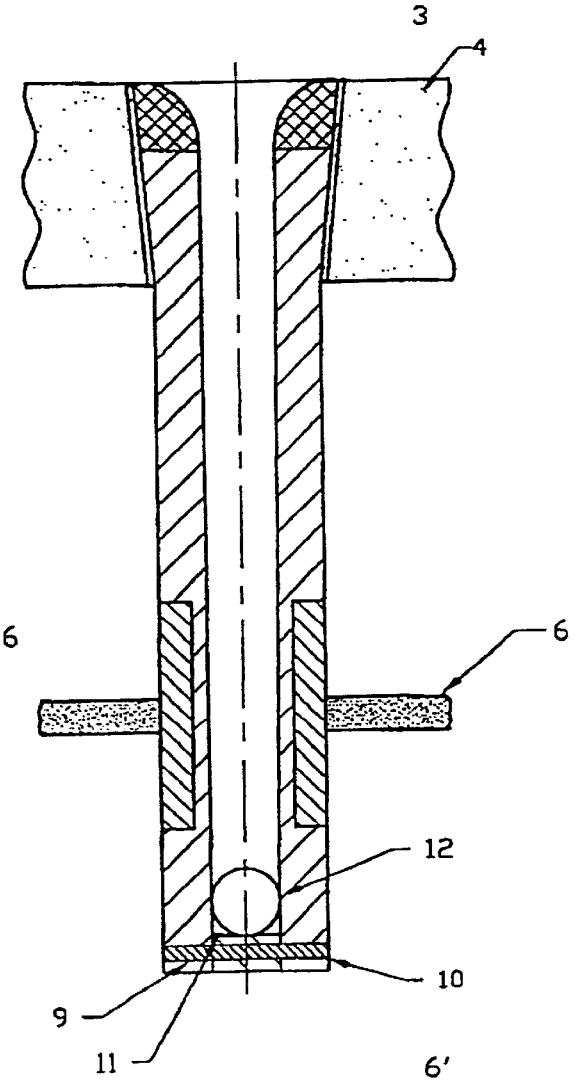
FIG. 6 is a cross-sectional view at 90° to FIG. 5.

FIGS. 5 and 6 illustrate a further embodiment of the present invention in which a segment 11 is filled within the lower bore 2 of the nozzle body 1, which defines the profile of the lower surfaces of the exit ports 12, and includes a sump 13 to further influence the flow characteristics of the molten metal emerging from the ports 12, generating a generally horizontal exit flow being more suitable for wider mould forms.

The segment 11 in FIGS. 5 and 6 is connected to the main body 1 by a locking means. The locking means comprises one or more ceramic retainers 9 that pass through corresponding apertures 10 in the main body and the tip of the nozzle.

When the exact casting requirements are known the most suitable lower segment can be selected and mounted to the submerge pour assembly to provide both the required steel flow characteristics by means of the geometrical design of the tip and the optimum material compatible with the casting risk, e.g. high corrosion resistance for high $O_2$ or $C_a$ treated grade or C free anti-clogging for Al killed grades.

In both versions described the design of the submerge pour assembly remains as standard to below the immersion level. The geometrical adjustments are achieved by changing segments which fit within the lower immersed region and offer various options of bore sizes, exit angles and material combinations which can be introduced into the specially adapted shape of the lower SEN body.

By this means the preferred exit flow can be established and as the joints between the two components are immersed below the metal surface in the mould there is no risk of air ingress to cause re-oxidation.

The present invention is, of course, in no way restricted to the specific disclosure of the specification and drawings, but also encompasses any modifications within the scope of the appended claims.

What is claimed is:

1. A refractory shroud device having an internal bore for through passage of molten metal, said device comprising, a body defining at least a portion of said bore, and having sufficient length to allow an end thereof to become immersed in a melt under normal operation conditions, and operationally engageable with said end, but not screwed, a replaceable segment defining outlet means in flow communication with said bore, the replaceable segment having an internal profile adapted to provide a control over the flow of molten metal from the device, wherein said replaceable segment is retained in said body by a push fit mechanism and wherein a joint between said end of the body and the replaceable segment is arranged such that the joint is immersed in the melt.

2. A refractory shroud device according to claim 1, wherein said replaceable segment is provided with a sump for altering the flow of molten metal from the device.

3. A refractory shroud device according to claim 1, wherein said replaceable segment is provided with a boss engageable in a corresponding recess in said body.

4. A refractory shroud device according to claim 1, wherein said replaceable segment is retained on said body by ceramic retainer passing through corresponding apertures in said body and said replaceable segment.

5. A refractory shroud device according to claim 2, wherein said replaceable segment is retained on said body by a ceramic retainer passing through corresponding apertures in said body and said replaceable segment.

* * * * *